US010239736B1

(12) United States Patent
Chaney et al.

(10) Patent No.: US 10,239,736 B1
(45) Date of Patent: Mar. 26, 2019

(54) ROPE RETAINER FOR A BOOM

(71) Applicant: Link-Belt Construction Equipment Co., L.P., LLLP, Lexington, KY (US)

(72) Inventors: Phillip Chaney, Lexington, KY (US); John P. Jones, Lexington, KY (US)

(73) Assignee: LINK-BELT CRANES, L.P., LLLP, Lexington, KY (US)

( * ) Notice: Subject to any disclaimer, the term of this patent is extended or adjusted under 35 U.S.C. 154(b) by 281 days.

(21) Appl. No.: 15/189,076

(22) Filed: Jun. 22, 2016

Related U.S. Application Data

(60) Provisional application No. 62/182,886, filed on Jun. 22, 2015.

(51) Int. Cl.
*B66D 1/36* (2006.01)

(52) U.S. Cl.
CPC ..... *B66D 1/36* (2013.01)

(58) Field of Classification Search
CPC ..... B66C 13/18; B66C 15/02; B66C 23/66
USPC ..... 254/383, 402, 403
See application file for complete search history.

(56) References Cited

U.S. PATENT DOCUMENTS

| | | | | |
|---|---|---|---|---|
| 2,363,353 A | | 11/1944 | Tudor et al. | |
| 2,479,009 A | | 8/1949 | Holmes et al. | |
| 3,843,094 A | * | 10/1974 | Watts | B66D 1/36 242/366 |
| 4,205,871 A | * | 6/1980 | Manabe | B66D 1/7415 254/333 |
| 4,293,109 A | | 10/1981 | Bramwell | |
| 6,059,266 A | * | 5/2000 | Ascherin | B64D 1/22 242/397.5 |
| 6,170,910 B1 | | 1/2001 | Bapst | |
| 6,283,455 B1 | * | 9/2001 | Ascherin | B64D 1/22 242/397.5 |
| 6,386,516 B1 | * | 5/2002 | Lenders | B66D 3/046 254/393 |
| 6,494,437 B1 | * | 12/2002 | Boyer | B08B 9/0436 212/232 |
| 6,672,670 B2 | | 1/2004 | Funk et al. | |
| 7,347,411 B1 | * | 3/2008 | Teel | B66D 3/046 254/402 |
| 7,607,644 B1 | * | 10/2009 | Gibb | B66F 7/02 254/333 |

(Continued)

FOREIGN PATENT DOCUMENTS

| | | | |
|---|---|---|---|
| GB | 244180 A | | 12/1925 |
| JP | 2009023838 A | * | 2/2009 |

OTHER PUBLICATIONS

Instructions for the installation of 3547 Flat Cable Retainer http://multimedia.3m.com/mws/media/98490O/flat-cable-retainer-3547.PDF © 1983 Minnesota Mining & Manufacturing Company.

*Primary Examiner* — Emmanuel M Marcelo
(74) *Attorney, Agent, or Firm* — King & Schickli, PLLC

(57) ABSTRACT

An apparatus assists in retaining a rope in connection with a sheave on a boom. The apparatus includes a retainer supported by the boom for swinging outwardly relative to the sheave from a first position adjacent to the sheave for assisting in retaining the rope therein and a second position for facilitating removing the rope from the sheave. A holder may be provided for holding the retainer in the second position, so that the operator's hands are freed for other tasks. A receiver may also be provided for temporarily receiving a locking pin once removed from the retainer, thus helping to guard against loss.

21 Claims, 4 Drawing Sheets

(56) References Cited

U.S. PATENT DOCUMENTS

| | | | | |
|---|---|---|---|---|
| 7,673,850 | B2 * | 3/2010 | John | B66B 11/043 254/402 |
| 8,958,681 | B2 | 2/2015 | Ripplinger | |
| 8,991,791 | B2 * | 3/2015 | Wright | B66D 1/36 254/333 |
| 2013/0187105 | A1 * | 7/2013 | Xydias | B66D 1/30 254/277 |
| 2015/0284223 | A1 * | 10/2015 | Hall | B66D 1/38 254/333 |

* cited by examiner

ROPE RETAINER FOR A BOOM

This application claims the benefit of U.S. Provisional Patent Application Ser. No. 62/182,886, the disclosure of which is incorporated herein by reference.

TECHNICAL FIELD

This disclosure relates generally to lifting booms and, more particularly, to a rope retainer for a boom.

BACKGROUND

A crane boom typically includes spaced sheaves over which a hoist rope may be reeved for use in raising and lowering objects of interest. In order to assist in securing the rope in place during use, a rope retainer or keeper may be fixed in place adjacent to the sheave. This retainer is typically in the form of a shaft mounted between brackets supported by a head of the boom, which helps to prevent the rope from losing contact with the sheave during the lifting operation and otherwise (such as during transport).

In this arrangement, an operator must access the boom head, which is typically high off the ground, and disassemble the rope retainer to reeve or adjust the rope. The conventional assembly creates a number of disadvantages, since the shaft must be unbolted and withdrawn from the corresponding mounting structures, at which point it is no longer supported and must also be held. Using only two hands, the operator must thus control the location of multiple parts and tools, all potentially while attempting to adjust the rope. This creates opportunities for tools and parts to be dropped, adding complexity to the process and slowing down the operation of readying the crane for use or repairing it.

Accordingly, a need exists for an improved and simplified rope retainer which eliminates the need for tools, decreases the number of parts involved, and speeds up the process of adjusting the rope relative to the sheaves.

SUMMARY

According to one aspect of the disclosure, an apparatus for assisting in retaining a rope on or in connection with a sheave on a boom is provided. The apparatus comprises a retainer supported by the boom for swinging outwardly relative to the sheave. The swinging is from a first position adjacent to the sheave for assisting in retaining the rope therein and a second position for facilitating removal of the rope from the sheave.

In one embodiment, the retainer comprises a shaft having a first end pivotally mounted at a first side of the boom and a second end releasably connected at a second side of the boom. A first support is provided for supporting the first end of the shaft and a second support for supporting a second end of the shaft. A holder may also be provided for holding the first support in the second position.

A pin may be provided for connecting the shaft to the second support in an operative condition. A receiver may also be associated with the boom for receiving the pin in a withdrawn condition. A first fastener may be connected to the first support providing a pivot point for the shaft, and a second fastener mounted for movement within a channel associated with the first support during the pivoting of the shaft about the first fastener.

The retainer may include a first shaft generally parallel to a second shaft supporting the sheave in the first position. The shaft forms an acute angle with the second shaft in the second position. The first shaft may include a roller.

According to a further aspect of the disclosure, an apparatus for assisting in retaining a rope in connection with a sheave rotatably supported on a first shaft connected to a boom and for allowing an operator to access the rope. The apparatus comprises a retainer for moving from a first position generally parallel to the first shaft for assisting in retaining the rope on the sheave to a second position skewed or askew relative to the first shaft for facilitating removing the rope from the sheave.

In one embodiment, the retainer comprises a second shaft having a first end pivotally mounted at a first side of the boom and a second end releasably connected at a second side of the boom. A first support may be provided for supporting the first end of the second shaft and a second support for supporting a second end of the second shaft. A holder is provided for holding the second shaft in the second position, along with a pin for connecting the second shaft to the second support in an operative condition. A receiver is also provided for receiving the pin in a withdrawn condition.

The apparatus may further include a first fastener connected to the first support forming a pivot point for the second shaft. A second fastener may be mounted for movement within a channel associated with the first support during the pivoting of the second shaft about the first fastener.

Still a further aspect of the disclosure pertains to a method for assisting in retaining a rope in connection with a sheave on a boom. The method comprises swinging a retainer from a first position for assisting in retaining the rope on the sheave to a second position for facilitating removing the rope from the sheave while the retainer remains connected to the boom. The method may further include the step of holding the retainer in the second position.

BRIEF DESCRIPTION OF THE DRAWING FIGURES

The accompanying drawing figures incorporated herein and forming a part of the specification, illustrate several aspects of the disclosed rope retainer and serve to explain certain principles thereof. In the drawing figures.

Reference will now be made in detail to the present preferred embodiments of the rope retainer, examples of which are illustrated in the accompanying drawing figures.

DETAILED DESCRIPTION

Figure 1:
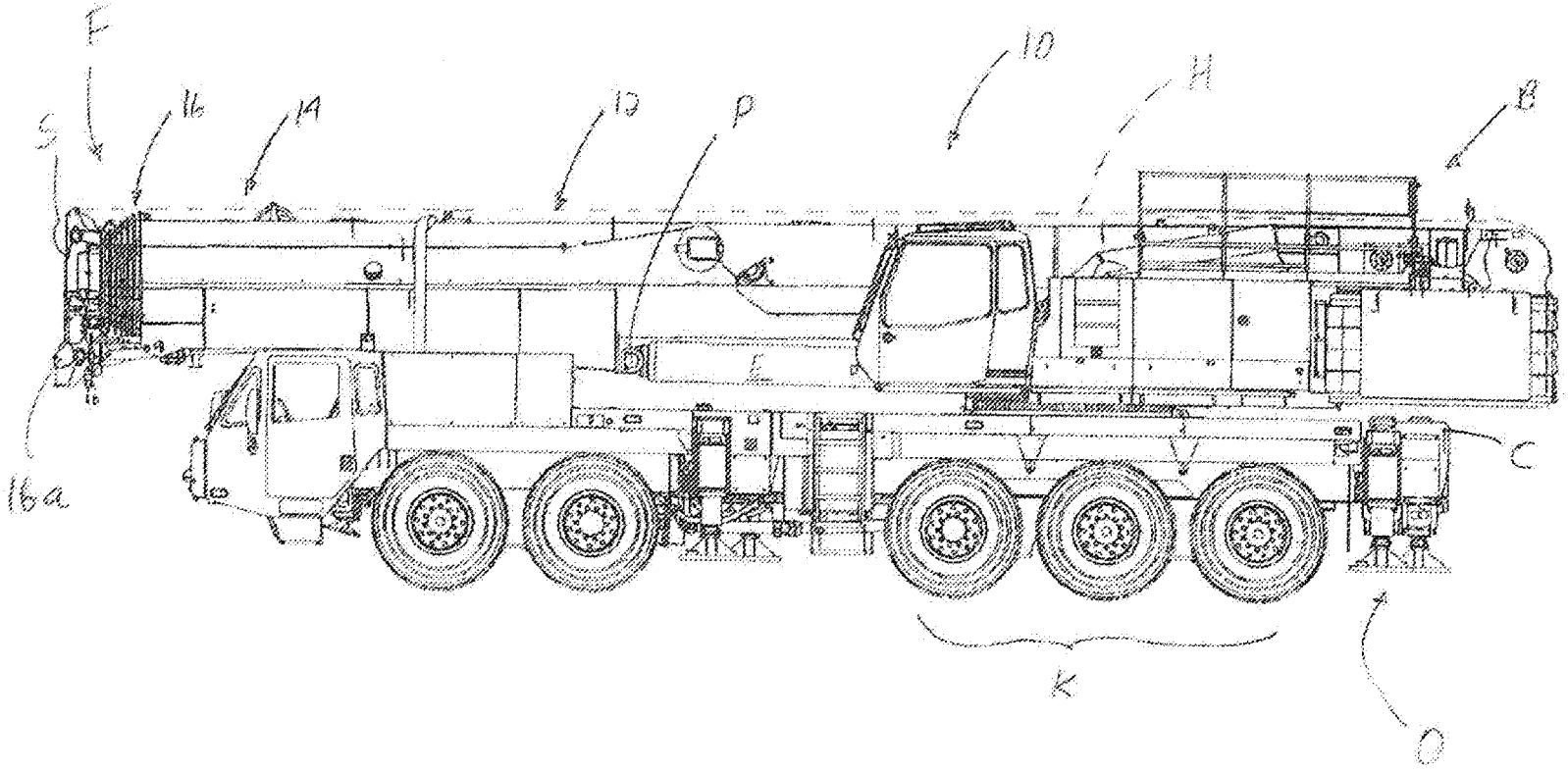
FIG. 1 is a side view of a mobile crane including a telescoping boom.

Reference is now made to FIG. 1, which provides an overall perspective view of a mobile crane 10 for which the inventions described herein may have utility, but is not intended to limit their applicability to a particular environment of use. In the embodiment illustrated in FIG. 1, this crane 10 includes a telescoping boom assembly 12 having at least two generally tubular boom sections, such as a base section 14 and one or more extensible sections 16. The first or outer base boom section 14 is pivotally mounted on a bodily rotatable base B supported by a chassis C having ground-engaging structures (e.g., wheels K or crawler tracks and outriggers O), while the second boom section 16 is telescopically received within the first or base boom section 14.

It should be appreciated that additional boom sections may be telescopically received within the second boom section 14 and so on. An internal hydraulic cylinder (not shown) is provided to move the telescoping boom sections 14, 16 relative to each other in a manner known in the art, and a lifter E, such as an external cylinder, connects with the boom assembly 12 at a connection point P, and can be used to pivot it in a vertical direction in a selective fashion to lift objects using a hoist rope H (shown in dashed line representation in FIG. 1), which may extend over one or more sheaves S at the boom head 16*a*.

Figure 2:
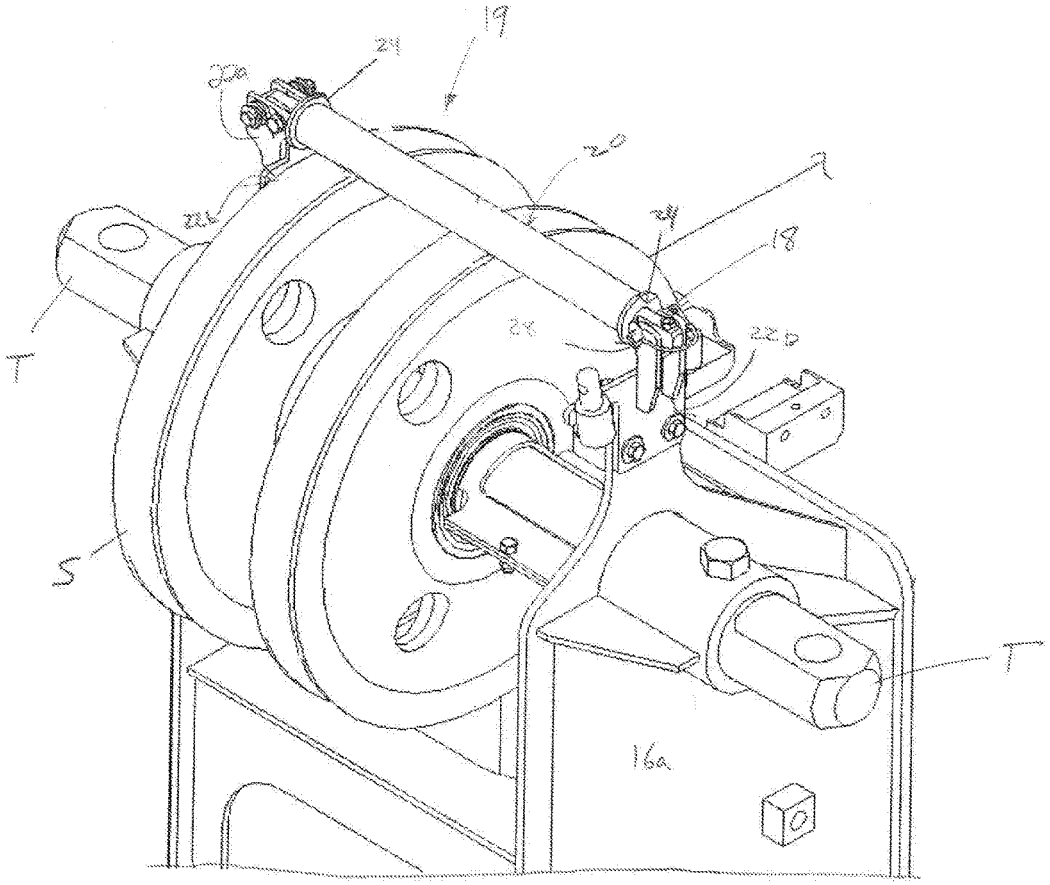
FIG. 2 is a partially cutaway perspective view of a retainer for assisting in retaining a rope on a sheave associated with a crane boom.

A rope retainer 19 is also provided for retaining the hoist rope H in association with the sheave S. With reference to FIG. 2, the retainer 19 includes a shaft 18. The shaft 18 may support a movable structure, such as a rotatable roller 20, for providing low-friction or rolling contact if engaged by the rope H. Corresponding spacers 24 may also be provided to facilitate the rolling of the roller 20 relative to the shaft 18 supporting it without interference from external structures.

Figure 5:
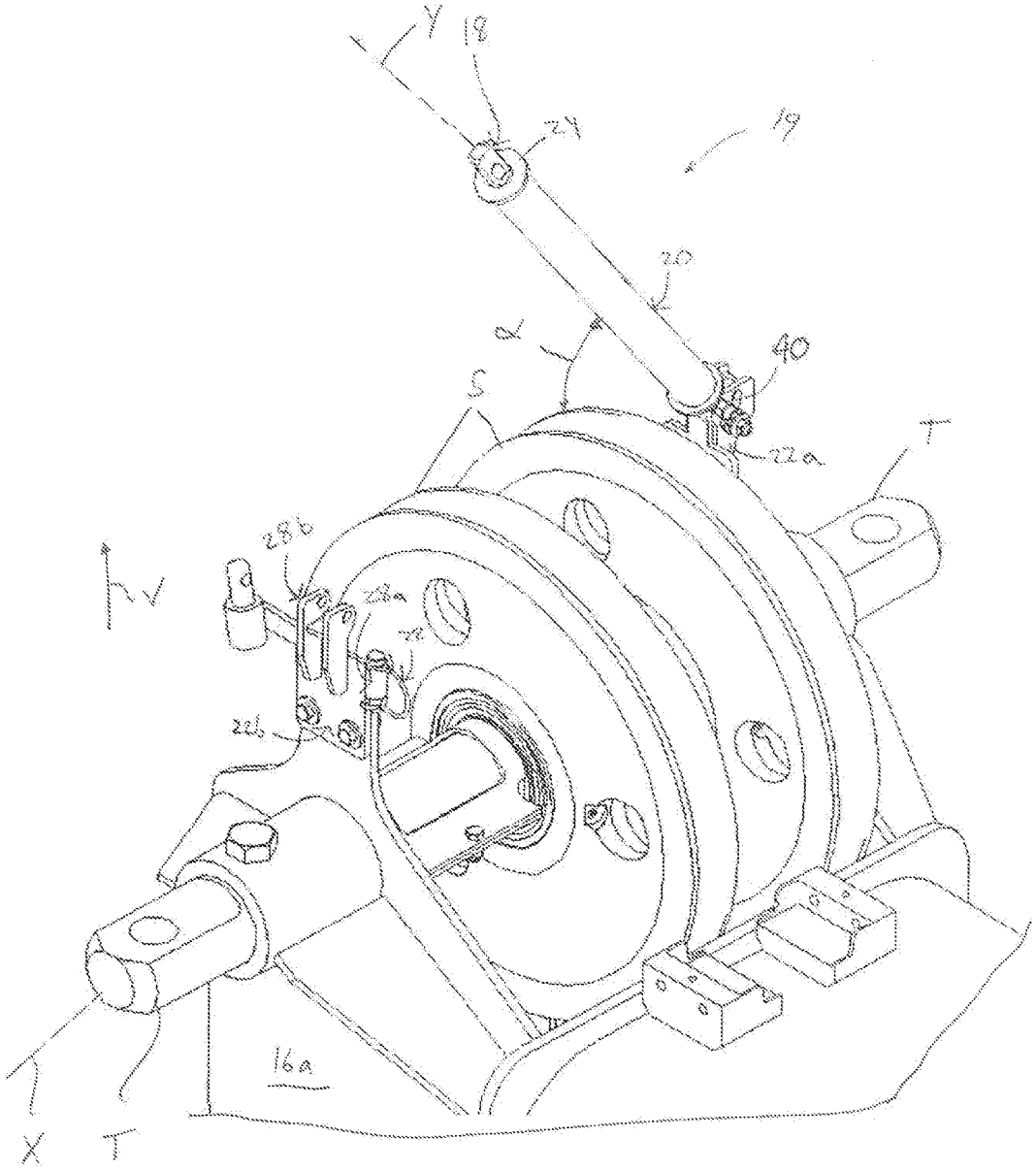
FIG. 5 is a partially cutaway perspective view showing the retainer in a withdrawn position.

The shaft 18 may be supported by the boom assembly 12 and, in particular, a head end 16*a* thereof, in a manner such that it may be easily withdrawn from the retained or operating condition closer to the sheave S, and moved to a retracted condition spaced farther away from the sheave and thus allowing for the operator to adjust the position of the rope H. In one particular embodiment, this may be done by mounting the shaft 18 for pivoting movement along one side of the boom assembly 12, such that it can swing outwardly relative to the sheave S (see FIG. 5). In one example, a first support 22*a* may pivotally support one end of the shaft 18 at one side of the boom head 16*a*, and a second support 22*b* may support a second end of the shaft 18 via a releasable connection at the other side, as outlined further in the following description.

Figure 3:
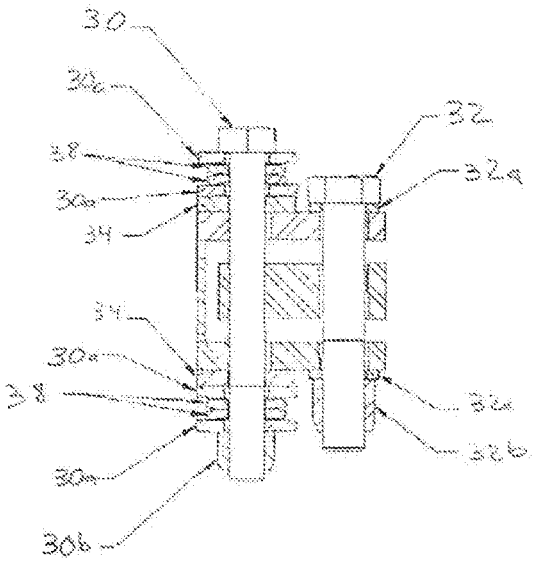
FIG. 3 is a cross-sectional top view of a holder forming a pivot point and also for holding the retainer in a non-deployed or withdrawn position.
Figure 4:
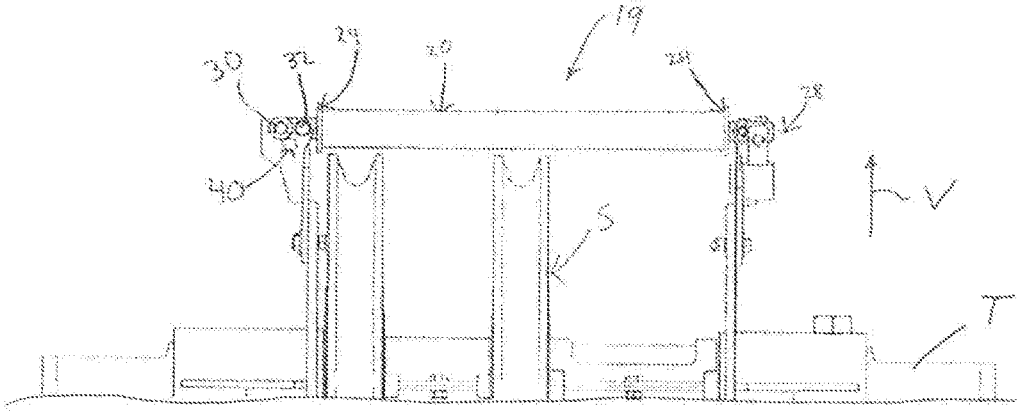
FIG. 4 is a partially cutaway side view illustrating the retainer in a deployed or retaining position.

With reference to FIGS. 3 and 4, the first support 22*a* may be associated with a structure for holding the shaft 18 in the withdrawn condition, swung away from the sheave S, so as to free the operator's hands for handling the rope or performing other tasks. This may be achieved using a holder for creating a sufficient amount of friction to hold the shaft 18 in the withdrawn position, yet not so much force that it would be difficult for the operator to move the shaft to this position. In the illustrated embodiment, this is accomplished by providing a first fastener, such as a bolt 32 (and associated washers 32*a* and a nut 32*b*) about which the shaft 18 is pivotally mounted in association with support 22*a* supported by the boom head 16*a*. A second fastener, such as a bolt 30, may also be provided in a channel 40 (which may be arcuate), and which may be associated with the holder. In the illustrated embodiment, the holder comprises a plurality of washers, such as regular washers 30*a*, friction washers 34, and conical washers 38, which may be held in place by a nut 30*b* secured to the bolt 30. However, other types of holders may also be used, such as for example a detent mechanism, a ratcheting mechanism, a spring to bias the shaft 18 toward the withdrawn position, or the like.

In order to provide the desired releasable support that allows for the movement or swinging of the retainer 19 between a deployed and a non-deployed position, the second support 22*b* may associate with a removable pin 28. The pin 28 may be adapted to pass though corresponding apertures in a receiver 28*b* associated with the support 22*b*, as well as the corresponding end of the shaft 18. An auxiliary receiver 28*a* may also be provided for temporarily receiving the pin 28 when removed or withdrawn from the receiver 28*b*, thereby helping to avoid potential loss during the manipulation of the retainer 19 and the rope H.

In use, the retainer 19 may become operational for swinging by first removing the pin 28 from the support 22*b*. The pin 28 once removed may then be placed in the auxiliary receiver 28*a* for secure keeping during the remainder of the operation. When the shaft 18 is released in this manner, it may be swung away from the sheave S to a fully withdrawn position (such as in the vertical direction V) to a skewed, unparallel orientation relative to the shaft T of the boom head 16*a* supporting the sheave(s) S (see FIG. 4), as contrasted with the non-deployed condition where the shaft 18 is generally parallel to shaft T (with "generally" meaning as close to parallel as possible so that the rope H is captured or retained in the sheave S).

In the askew orientation, which is an orientation for allowing the rope H to be fully removed from the sheave(s) S in a transverse direction (which is orthogonal to the axis of rotation), the longitudinal axis Y of the shaft 18 forms an acute angle $\alpha$ with the longitudinal axis X of the shaft T supporting the sheave(s) S. This is contrasted with the situation when shaft 18 is lowered to the home or deployed position for retaining the rope H, in which the two axes X, Y are generally parallel.

When withdrawn in this manner, the shaft 18 is automatically held in place by the holder and, in particular, the frictional engagement created by the washers 30*a*, 34, 38. This retention feature, along with the placement of the pin 28 in the holder 28*a* (which may also include a tether), reduces the chances of dropped parts (which can be a significant issue, given the height of the sheave S relative to the ground; see FIG. 1). Furthermore, once the shaft 18 is pivoted, the frictional engagement afforded avoids the need for the operator holding the shaft in place while reeving the hoist rope H through the sheave S. The easy pivoting nature of the arrangement also allows the operator to use only one hand to manipulate the retainer 19.

The foregoing description of certain embodiments provides the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. An apparatus for assisting in retaining a rope, comprising:

a boom including a sheave attached to the boom for engaging the rope; and a retainer supported by the boom for swinging outwardly relative to the sheave from a first position adjacent to the sheave for assisting in retaining the rope thereon and a second position for facilitating removal of the rope from the sheave.

2. The apparatus of claim 1, wherein the retainer comprises a shaft, the shaft having a first end pivotally mounted at a first side of the boom and a second end releasably connected at a second side of the boom.

3. The apparatus of claim 2, further including a first support for supporting the first end of the shaft and a second support for supporting a second end of the shaft.

4. The apparatus of claim 3, further including a holder for holding the first support in the second position.

5. The apparatus of claim 4, further including a pin for connecting the shaft to the second support in an operative condition.

6. The apparatus of claim 5, further including a receiver associated with the boom for receiving the pin in a withdrawn condition.

7. The apparatus of claim 3, further including:

a first fastener connected to the first support providing a pivot point for the shaft; and a second fastener mounted for movement within a channel associated with the first support during the pivoting of the shaft about the first fastener.

8. The apparatus of claim 1, wherein the retainer includes a first shaft generally parallel to a second shaft supporting the sheave in the first position and forming an acute angle with the second shaft in the second position.

9. The apparatus of claim 1, wherein the retainer comprises a shaft including a roller.

10. A crane including the apparatus of claim 1.

11. An apparatus for assisting in retaining a rope, comprising:

a boom including a sheave rotatably supported on a first shaft attached to the boom; and a retainer connected to the boom for moving from a first position generally parallel to the first shaft for assisting in retaining the rope on the sheave to a second position askew relative to the first shaft for facilitating removal of the rope from the sheave.

12. The apparatus of claim 11, wherein the retainer comprises a second shaft, the second shaft having a first end pivotally mounted at a first side of the boom and a second end releasably connected at a second side of the boom.

13. The apparatus of claim 12, further including a first support for supporting the first end of the second shaft and a second support for supporting a second end of the second shaft.

14. The apparatus of claim 13, further including a holder for holding the second shaft in the second position.

15. The apparatus of claim 13, further including a pin for connecting the second shaft to the second support in an operative condition.

16. The apparatus of claim 15, further including a receiver associated with the boom for receiving the pin in a withdrawn condition.

17. The apparatus of claim 13, further including:

a first fastener connected to the first support forming a pivot point for the second shaft; and a second fastener mounted for movement within a channel associated with the first support during the pivoting of the second shaft about the first fastener.

18. A crane including the apparatus of claim 11.

19. A method for assisting in retaining a rope in connection with a sheave on a boom, comprising:

swinging a retainer from a first position for assisting in retaining the rope on the sheave attached to the boom to a second position for facilitating removing the rope from the sheave while the retainer remains connected to the boom.

20. The method of claim 19, further including the step of holding the retainer in the second position.

21. An apparatus for assisting in retaining a rope, comprising:

a boom including a sheave for engaging the rope; and a retainer supported by the boom for swinging outwardly relative to the sheave from a first position adjacent to the sheave for assisting in retaining the rope thereon and a second position for facilitating removal of the rope from the sheave;

wherein the retainer comprises a shaft having a first end pivotally mounted at a first side of the boom and a second end releasably connected at a second side of the boom.

* * * * *